US006872470B2

(12) United States Patent
Minamikawa

(10) Patent No.: US 6,872,470 B2
(45) Date of Patent: Mar. 29, 2005

(54) NICKEL-GOLD PLATING EXHIBITING HIGH RESISTANCE TO CORROSION

(75) Inventor: Yoshihiro Minamikawa, Ogaki (JP)

(73) Assignee: Ibiden Co., Ltd., Ogaki (JP)

( * ) Notice: Subject to any disclaimer, the term of this patent is extended or adjusted under 35 U.S.C. 154(b) by 0 days.

(21) Appl. No.: 10/204,861

(22) PCT Filed: Feb. 19, 2001

(86) PCT No.: PCT/JP01/01183

§ 371 (c)(1),
(2), (4) Date: Aug. 26, 2002

(87) PCT Pub. No.: WO01/63007

PCT Pub. Date: Aug. 30, 2001

(65) Prior Publication Data

US 2003/0022017 A1 Jan. 30, 2003

(30) Foreign Application Priority Data

Feb. 24, 2000 (JP) ..... 2000-047221
Feb. 24, 2000 (JP) ..... 2000-047224

(51) Int. Cl.[7] ..... B32B 15/01; C23C 28/00

(52) U.S. Cl. ..... 428/672; 428/680; 428/929; 439/886

(58) Field of Search ..... 428/680, 672, 428/935, 929; 439/886

(56) References Cited

U.S. PATENT DOCUMENTS 4,601,958 A * 7/1986 Levine ..... 428/672
4,620,661 A * 11/1986 Slatterly ..... 228/209
4,835,067 A * 5/1989 Levine ..... 428/669
4,842,961 A * 6/1989 Basile et al. ..... 428/672
5,051,317 A * 9/1991 Solidum ..... 428/671

FOREIGN PATENT DOCUMENTS

| | | | |
|---|---|---|---|
| JP | 9-176864 | | 7/1997 |
| JP | 10-251860 | * | 9/1998 |
| JP | 2002-076189 | * | 3/2002 |
| JP | 2002-110838 | * | 4/2002 |

* cited by examiner

*Primary Examiner*—John J. Zimmerman
(74) *Attorney, Agent, or Firm*—Oblon, Spivak, McClelland, Maier & Neustadt, P.C.

(57) ABSTRACT

A nickel-gold plating exhibiting high resistance to corrosion, which has a nickel plating layer formed on a base metal (1) and a gold plating layer (3) formed thereon, characterized in that the nickel plating layer (2) has a corrosion potential being brought close to that of the gold plating layer (3) through the reduction of the sulfur content of the nickel plating layer; or which has a first nickel plating layer (6) formed on a base metal, a second nickel plating layer (7) formed on the first nickel plating layer and a gold plating layer formed thereon, characterized in that the first nickel plating layer has a corrosion potential nobler (higher) than that of the second nickel plating layer. The nickel-gold plating exhibits only a mild local cell phenomenon between the gold plating layer and a nickel plating layer directly thereunder even under corrosive conditions, which leads to retardation of the corrosion through pitting and thus to a satisfactory durability of the plating with relatively thin respective plating layers. Accordingly, the nickel-gold plating achieves a high resistance to corrosion with little impairment of production cost or productivity.

18 Claims, 2 Drawing Sheets

NICKEL-GOLD PLATING EXHIBITING HIGH RESISTANCE TO CORROSION

TECHNICAL FIELD

The present invention relates to nickel-gold plating exhibiting high resistance to corrosion which is used for applications such as a terminal surface in an IC card. More specifically, the invention relates to a nickel-gold plating exhibiting high resistance to corrosion in which pitting corrosion due to a pin hole of a gold plating layer is prevented and durability is improved.

BACKGROUND ART

An IC card which takes the place of conventional magnetic cards has a terminal for accessing from an equipment side. Since the surface of the terminal requires high resistance to corrosion and hardness for permanent use, an IC card which is subject to two-layered plating of nickel and gold on a copper substrate is generally used.

However, in the general nickel-gold plating, the resistance to corrosion is insufficient. More concretely, there is a problem that pitting corrosion easily occurs on the nickel plating layer due to a pinhole existing on the gold plating layer. On the contrary, countermeasures such that a nickel plating layer and/or a gold plating layer are/is thickened is considered, but there arises a problem of costs and productivity. Therefore, this is not the essential resolution.

The present invention is devised in order to solve the above-mentioned problem of the conventional nickel-gold plating. Namely, its object is to provide nickel-gold plating exhibiting high resistance to corrosion which realizes high resistance to corrosion without sacrificing costs and productivity.

DISCLOSURE OF THE INVENTION

Nickel-gold plating exhibiting high resistance to corrosion of the present invention which is devised in order to solve the above problem includes: a nickel plating layer provided on a ground metal; and a goldplating layer provided on the nickel plating layer, wherein a difference between a corrosion potential of the nickel plating layer and a corrosion potential of the gold plating layer is within a range of 1800 to 1840 mV. Preferably, a content of sulfur of the nickel plating layer is within a range of 0.001 to 0.01 weight %.

As a result of enthusiastic study by the inventor, it was found that pitting corrosion was concerned with local battery phenomenon. Namely, in the general nickel-goldplating, a difference in corrosion potential between the gold plating layer and the nickel plating layer is 1930 mV, namely, large, and if a slight pin hole exists in the gold plating layer, the base nickel plating layer is eroded further due to the local battery phenomenon so that pitting corrosion occurs. Since gold and nickel just after gold plating do not form passivity under normal corrosion environment, it is approximately allowable that a reference electrode potential is directly considered as a corrosion potential. As a result of study by the inventor, a content of sulfur in the nickel plating layer (in normal nickel plating, about 0.04 weight %) was reduced so that the corrosion potential in the nickel plating layer could be noble, namely, it could be close to a corrosion potential in the gold plating layer.

In the nickel-gold plating exhibiting high resistance to corrosion of the present invention, a difference between the corrosion potential of the nickel plating layer and the corrosion potential of the gold plating layer is made to be small within a realistically possible range based on the above understanding. Therefore, the local battery phenomenon between the gold plating layer and the nickel plating layer is moderate, and resistance to corrosion is improved. Accordingly, even if a slight pin hole exists in the gold plating layer or thickness of the respective plating layers are not thickened much, sufficient durability is provided.

Nickel-gold plating exhibiting high resistance to corrosion according to another mode of the present invention includes: a first nickel plating layer provided on a ground metal; a second nickel plating layer provided on the first nickel plating layer; and a gold plating layer provided on the second nickel plating layer, wherein a corrosion potential of the first nickel plating layer is higher (nobler) than a corrosion potential of the second nickel plating layer. Preferably, a content of sulfur of the first nickel plating layer is within a range of 0.001 to 0.01 weight %.

As a result of enthusiastic study by the inventor, it was found that pitting corrosion was concerned with local battery phenomenon. Namely, in the general nickel-gold plating a difference in corrosion potential between the gold plating layer and the nickel plating layer is 1930 mV, namely, large, and if a slight pin hole exists in the gold plating layer, the base nickel plating layer is eroded further due to the local battery phenomenon so that pitting corrosion occurs. Since gold and nickel just after gold plating do not form passivity under normal corrosion environment, it is approximately allowable that a reference electrode potential is directly considered as corrosion potential.

The inventor found that the local battery phenomenon could not be eliminated, but two nickel plating layers are provided and an upper layer (second nickel plating layer) is made to be base so that substantially resistance to corrosion was improved. In this state, since corrosion due to the local battery phenomenon centralizes in the second nickel plating layer, as a result, sacrificial anticorrosion which protects the first nickel plating layer acts. Further as a result of study by the inventor, a content of sulfur in the nickel plating layer (in normal nickel plating, about 0.04 weight %) was reduced so that the corrosion potential in the nickel plating layers could be noble, namely, it could be close to a corrosion potential in the gold plating layer.

In the nickel-gold plating exhibiting high resistance to corrosion according to this mode of the present invention, the nickel plating layer (first nickel plating layer) in which the corrosion potential is noble within a realistically possible range is provided just on the base metal, the normal nickel plating layer (second nickel plating layer) is further provided on the first nickel plating layer, and the gold plating layer is further provided on the second nickel plating layer. Therefore, even if a slight pin hole exists in the gold plating layer or thickness of the respective plating layers are not thickened much, sufficient durability is provided by the sacrificial anticorrosive action of the second nickel plating layer.

BEST MODE FOR CARRYING OUT THE INVENTION

There will be detailed below embodiments which specifically show nickel-gold plating exhibiting high resistance to corrosion of the present invention with reference to the drawings.

(First Embodiment)

Figure 1:
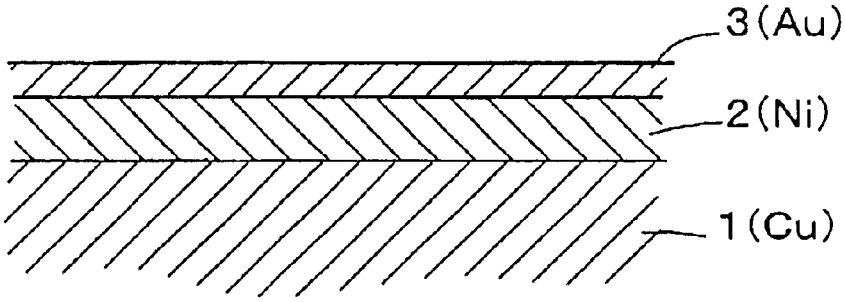
FIG. 1 is a cross sectional view showing a structure of nickel-gold plating exhibiting high resistance to corrosion according to an embodiment.

Nickel-gold plating exhibiting high resistance to corrosion according to the present embodiment is suitable for a terminal of an IC card substrate, and has a structure shown in FIG. 1. Namely, a nickel plating layer 2 is formed on a surface of a copper layer 1 and a gold plating layer 3 is further formed thereon. The copper layer 1 is a part of a copper pattern composing a wiring layer of the IC card substrate and it is formed by copper foil laminating or copper plating.

The nickel plating layer 2 on the copper layer 1 is a film which is formed by electro-plating using so-called watt bath mainly containing nickel sulfate, nickel chloride and boracic acid. The plating layer has a role bearing hardness for resistance to iterant contact with external equipment. Its thickness is within the range of 2 to 4 $\mu$m. The gold plating layer 3 on the nickel plating layer 2 is a normal gold plating layer which is formed by electroplating using cyan bath. This plating layer has a role bearing resistance to corrosion and exterior decorativeness. Moreover it has a function for reducing contact resistance at the time of the contact with an external equipment. Its thickness is about 0.15 $\mu$m.

Although the nickel plating layer of a normal IC card substrate contains sulfur of about 0.04 weight %, in the nickel plating layer 2 of the present embodiment, a content of sulfur is reduced to the range of 0.001 to 0.01 weight %. In order to achieve this, plating bath, in which an adding amount of sulfuric additive to be used for giving gloss is reduced from a normal amount, may be used. Moreover, a compounding ratio of the nickel sulfate to the nickel chloride may be changed so that an amount of the nickel chloride is larger. The inventor of the present invention measured a content of sulfur of the nickel plating layer 2 using burning-infrared light absorbing method. For this reason, the nickel plating layer 2 was peeled from a sample in a state before gold plating so as to be measured.

Figure 2:
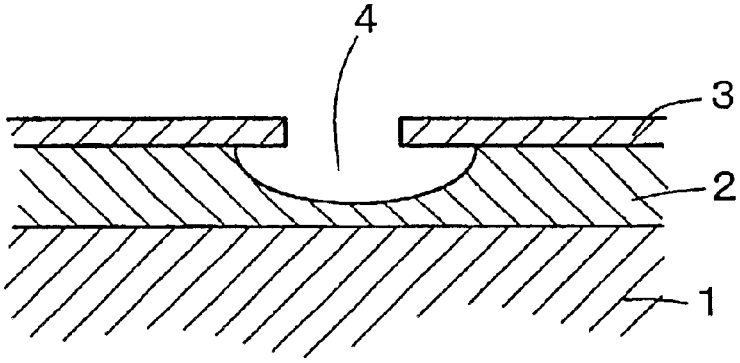
FIG. 2 is a cross sectional view explaining pitting corrosion of a nickel plating layer.

The nickel-gold plating exhibiting high resistance to corrosion displays the following corrosion behavior under the normal use conditions. Namely, about 30 pin holes/mm$^2$ of pin holes inevitably exist on the gold plating layer 3. This is because a thickness of the gold plating layer 3 is about 0.15 $\mu$m, namely, not particularly thick. For this reason, as shown in FIG. 2, pitting corrosion of the nickel plating layer 2, which is started from the pin hole 4 of the gold plating layer 3, still occurs.

However, since a content of sulfur in the nickel plating layer 2 is reduced as mentioned above, a corrosion potential of the nickel plating layer 2 is about 1800 to 1840 mV lower (base) than a corrosion potential of the gold plating layer 3. For this reason, a local battery phenomenon between both the plating layers is moderated. Therefore, the proceeding of the pitting corrosion shown in FIG. 2 is slow. The nickel-gold plating exhibiting high resistance to corrosion according to the present embodiment displays sufficiently high durability practically. If a content of sulfur of the nickel plating layer 2 is about 0.04 weight % which is the same as the normal condition, a difference in the corrosion potentials between the nickel plating layer 2 and the gold plating layer 3 is about 1930 mV. In this state, since the local battery phenomenon is remarkable and the pitting corrosion progresses quickly, the durability is not enough. The inventor of the present invention defines a voltage indicating value of a sample before gold plating by means of an electrolytic film thickness gauge as a corrosion potential. It is considered that this is approximately equal with a reference electrode potential as a relative comparison value.

In addition, when the inventor made an evaluation in a salt spray test, the nickel-gold plating exhibiting high resistance to corrosion according to the present embodiment required about 96 hours until color change. This is about 8 times as long as the conventional nickel-gold plating requiring about 12 hours, and thus this is sufficient practically.

As detailed above, as for the nickel-gold plating exhibiting high resistance to corrosion according to the present embodiment, in the layer structure having the nickel plating layer 2 on the copper layer 1 and the gold plating layer 3 thereon, since the corrosion potential of the nickel plating layer 2 is made to be close to the corrosion potential of the gold plating layer 3, the local battery phenomenon between the nickel plating layer 2 and the goldplating layer 3 is moderate even in the corrosive environment. Therefore, a speed of the corrosion due to the pitting corrosion is slow, and even if the respective plating layers are not thickened much, sufficient durability is displayed.

The present embodiment is simply an example and this does not limit the present invention. Therefore, needless to say, the present invention can be improved and modified within a scope which does not diverge from the gist. For example, in the present embodiment, in order to make the corrosion potential of the nickel plating layer 2 noble, a content of sulfur is reduced, but instead a content of carbon may be increased because the similar effect can be obtained. Needless to say, the corrosion potential may be adjusted by another means. Moreover, the present invention can be used for another applications other than a terminal of an IC card.

(Second Embodiment)

Figure 3:
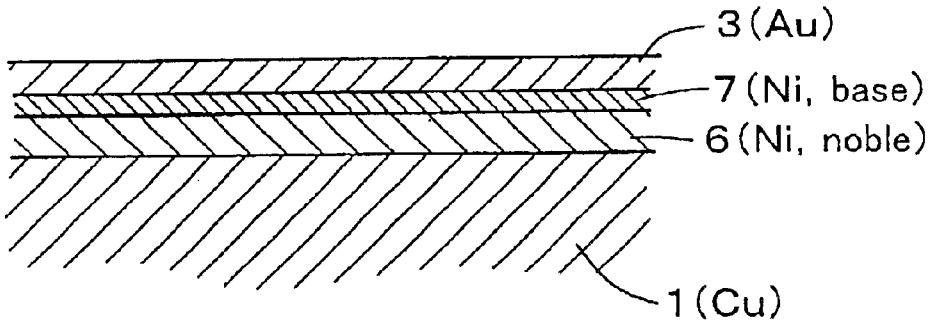
FIG. 3 is a cross sectional view showing a structure of nickel-gold plating exhibiting high resistance to corrosion according to an embodiment.

The nickel-gold plating exhibiting high resistance to corrosion according to the present embodiment is suitable for a terminal of an IC card substrate and has a structure shown in FIG. 3. Namely, a first nickel plating layer 6 is formed on a surface of a copper layer 1, and a second nickel plating layer 7 is further formed on the first nickel plating layer 6, and a gold plating layer 3 is further formed on the second nickel plating layer 7. The copper layer 1 is a part of a copper pattern composing a wiring layer of an IC card substrate, and it is formed by a copper foil laminate or copper plating.

The first nickel plating layer 6 on the copper layer 1 and the second nickel plating layer 7 thereon are films which are formed by electro-plating using so-called watt bath mainly containing nickel sulfate, nickel chloride and boracic acid. The nickel plating layers have a role bearing hardness for resistance to iterant contact with an external equipment. A total thickness is within the range of 2 to 4 $\mu$m. The gold plating layer 3 on the second nickel plating layer 7 is the same as the gold plating layer 3 in the first embodiment.

While the nickel plating layer of a normal IC card substrate contains sulfur of about 0.04 weight %, in the first nickel plating layer 6 of the present embodiment, a content of sulfur is reduced to the range of 0.001 to 0.01 weight %. In order to achieve this, plating bath, in which an adding amount of sulfuric additive to be used for giving gloss is reduced from a normal amount, may be used. Moreover, a compounding ratio of the nickel sulfate to the nickel chloride may be changed so that an amount of the nickel chloride is larger. On the contrary, the second nickel plating layer 7 is equivalent to a normal nickel plating layer. The inventor of the present invention measured a content of sulfur of the respective nickel plating layers using burning-infrared light absorbing method. For this reason, the nickel plating layers were peeled from a sample which was coated with the respective nickel plating layers so that the sample was measured.

Figure 4:
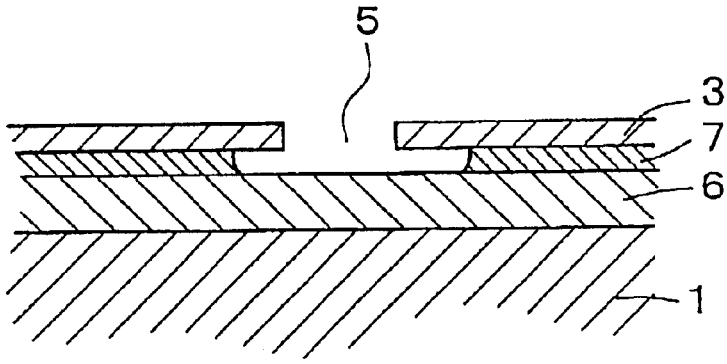
FIG. 4 is a cross sectional view explaining a state that a first nickel plating layer is protected.

The nickel-gold plating exhibiting high resistance to corrosion displays the following corrosion behavior under the normal use conditions. Namely, about 30 pin holes/$mm^2$ of pin holes inevitably exist on the gold plating layer 3. This is because a thickness of the gold plating layer 3 is about 0.15 $\mu$m, namely, not particularly thick. For this reason, as shown in FIG. 4, pitting corrosion on the second nickel plating layer 7, which is started from the pin hole 5 of the gold plating layer 3, still occurs.

However, since a content of sulfur in the first nickel plating layer 6 is reduced as mentioned above, a corrosion potential of the first nickel plating layer 6 is about 110 mV higher (noble) than a corrosion potential of the second nickel plating layer 7. For this reason, sacrificial anticorrosive protection acts on the first nickel plating layer 6 due to the corrosion of the second nickel plating layer 7. Therefore, as shown in FIG. 4, the first nickel plating layer 6 is seldom eroded. As a result, the nickel-gold plating exhibiting high resistance to corrosion according to the present embodiment displays sufficiently high durability practically. If a content of sulfur of the first nickel plating layer 6 is about 0.04 weight % which is the same as the normal condition, sacrificial anticorrosive protection does not act. In this case, since pitting corrosion proceeds also on the first nickel plating layer 6 due to the local battery phenomenon, the durability is not sufficient. The inventor of the present invention defines a voltage indicating value of a sample having only the respective nickel plating layers by means of an electrolytic film thickness gauge as a corrosion potential. It is considered that this is approximately equal with a reference electrode potential as a relative comparison value.

In addition, when the inventor made an evaluation in a salt spray test, the nickel-gold plating exhibiting high resistance to corrosion according to the present embodiment required about 96 hours until color change. This is about 8 times as long as the conventional nickel-gold plating requiring about 12 hours, and thus this is sufficient practically.

As detailed above, as for the nickel-gold plating exhibiting high resistance to corrosion according to the present embodiment, in the layer structure having the nickel plating layer on the copper layer 1 and the gold plating layer 3 thereon, the two upper and lower nickel plating layers are provided and the first nickel plating layer 6 on the lower layer has the nobler corrosion potential than that of the second nickel plating layer 7 on the upper layer. For this reason, the first nickel plating layer 6 is protected by the action of the sacrificial anticorrosive protection of the second nickel plating layer 7 under the corrosion phenomenon. Therefore, a speed of the corrosion in the first nickel plating layer 6 is slow, and even if the respective plating layers are not thickened much, sufficient durability is displayed.

The present embodiment is simply an example and this does not limit the present invention. Therefore, needless to say, the present invention can be improved and modified within a scope which does not diverge from the gist. For example, in the present embodiment, in order to make the corrosion potential of the first nickel plating layer 6 noble, a content of sulfur is reduced, but instead a content of carbon may be increased because the similar effect can be obtained. Needless to say, the corrosion potential may be adjusted by another means. In another way, the first nickel plating layer 6 is a normal nickel plating layer, and the corrosion potential of the second nickel plating layer 7 may be lowered (base) by increasing a content of sulfur in comparison with the normal potential. Moreover, the present invention can be used for another applications other than a terminal of an IC card.

INDUSTRIAL APPLICABILITY

As explained above, the present invention provides the nickel-gold plating exhibiting high resistance to corrosion, in which high resistance to corrosion is realized without sacrificing costs and productivity much.

What is claimed is:

1. An external terminal of an IC card which comprises:

nickel-gold plating exhibiting high resistance to corrosion, comprising:

a nickel plating layer provided on a ground metal; and a gold plating layer provided on said nickel plating layer, wherein a difference between a corrosion potential of said nickel plating layer and a corrosion potential of said gold plating layer is adjusted within a range of 1800 to 1840 mV.

2. An external terminal of an IC card according to claim 1, wherein a content of sulfur of said nickel plating layer is within a range of 0.001 to 0.01 weight %.

3. A nickel-gold plating exhibiting high resistance to corrosion, comprising:

a first nickel plating layer provided on a ground metal;

a second nickel plating layer provided on said first nickel plating layer; and a gold plating layer provided on said second nickel plating layer, wherein a corrosion potential of said first nickel plating layer is adjusted to be higher (noble) than a corrosion potential of said second nickel plating layer;

wherein a difference between a corrosion potential of said nickel plating layer and a corrosion potential of said sold plating layer is adjusted within a range of 1800 to 1840 mV or wherein a content of sulfur of said first nickel plating layer is within a range of 0.001 to 0.01 weight %, or both.

4. The nickel-gold plating exhibiting high resistance to corrosion according to claim 3, wherein a content of sulfur of said first nickel plating layer is within a range of 0.001 to 0.01 weight %.

5. An external terminal of an IC card according to claim 1, wherein said nickel plating layer is an electroplated film.

6. An external terminal of an IC card according to claim 1, wherein said gold plating layer is an electroplated film.

7. An external terminal of an IC card according to claim 1, wherein said nickel plating layer is an electroplated film formed with plating solution consisting of nickel sulfate and nickel chloride.

8. The external terminal of an IC card of claim 1, wherein the ground metal is copper.

9. An external terminal of an IC card according to claim 1, wherein said gold plating layer has pin holes.

10. The nickel-gold plating exhibiting resistance to corrosion according to claim 3, wherein a corrosion potential of said-first-nickel plating layer is higher (noble) than a corrosion potential of said second nickel plating layer.

11. The nickel-gold plating exhibiting resistance to corrosion according to claim 3, wherein said first and second nickel plating layers are electroplated films.

12. The nickel-gold plating exhibiting resistance to corrosion according to claim 3, wherein said gold plating layer is an electroplated film.

13. The nickel-gold plating exhibiting resistance to corrosion according to claim 3, wherein said first and second nickel plating layers are electroplated films formed with plating solution consisting of nickel sulfate and nickel chloride.

14. The nickel-gold plating exhibiting resistance to corrosion according to claim 3, which forms an external terminal of an IC card.

15. The nickel-gold plating exhibiting resistance to corrosion according to claim 3, wherein said gold plating layer has pin holes.

16. The nickel-gold plating according to claim 3, wherein a difference between a corrosion potential of said nickel plating layer and a corrosion potential of said gold plating layer is adjusted within a range of 1800 to 1840 mV.

17. The nickel-gold plating according to claim 16, wherein a content of sulfur of said first nickel plating layer is within a range of 0.001 to 0.01 weight %.

18. The nickel-gold plating according to claim 3, wherein said ground metal is copper.

* * * * *